US008660283B2

(12) United States Patent
Madsen et al.

(10) Patent No.: US 8,660,283 B2
(45) Date of Patent: Feb. 25, 2014

(54) HEARING AID HAVING A BEHIND THE EAR COMPONENT

(75) Inventors: Steen Madsen, Smørum (DK); Thor Højlund Olsen, Smørum (DK)

(73) Assignee: Oticon A/S, Smorum (DK)

( * ) Notice: Subject to any disclaimer, the term of this patent is extended or adjusted under 35 U.S.C. 154(b) by 0 days.

(21) Appl. No.: 13/418,969

(22) Filed: Mar. 13, 2012

(65) Prior Publication Data

US 2012/0237066 A1 Sep. 20, 2012

Related U.S. Application Data

(60) Provisional application No. 61/452,232, filed on Mar. 14, 2011.

(30) Foreign Application Priority Data

Mar. 14, 2011 (EP) ..... 11258149

(51) Int. Cl.
*H04R 25/00* (2006.01)

(52) U.S. Cl.
USPC ..... 381/322; 381/323; 381/330

(58) Field of Classification Search
USPC ..... 381/330, 381, 322, 323
See application file for complete search history.

(56) References Cited

U.S. PATENT DOCUMENTS

| | | | | | |
|---|---|---|---|---|---|
| 3,475,566 | A | * | 10/1969 | Bauer | 381/323 |
| 5,140,108 | A | * | 8/1992 | Miyajima | 174/563 |
| 2002/0076074 | A1 | | 6/2002 | Biermans | |
| 2003/0156726 | A1 | | 8/2003 | Morales et al. | |

FOREIGN PATENT DOCUMENTS

| | | | |
|---|---|---|---|
| CH | 473624 | A | 5/1969 |
| CH | 650664 | A5 | 8/1985 |
| DE | 19502994 | A1 | 8/1995 |
| DE | 102009030552 | A1 | 12/2010 |

* cited by examiner

*Primary Examiner* — Davetta W Goins
*Assistant Examiner* — Amir Etesam
(74) *Attorney, Agent, or Firm* — Birch, Stewart, Kolasch & Birch, LLP

(57) ABSTRACT

A hearing aid is provided having a behind the ear component comprising a casing adapted to cover, accommodate or protect electronics components of the hearing aid. Further the hearing aid has at least one through going opening in the casing element and electronic switching elements placed at the through going opening. According to the invention a plate element is provided, which is mountable in the through going opening and adapted to form, when mounted herein, a surface flush with the casing. This plate element which covers the switches is used when the switches has been disabled such as is often the case with hearing aids for small children.

5 Claims, 7 Drawing Sheets

HEARING AID HAVING A BEHIND THE EAR COMPONENT

CROSS REFERENCE TO RELATED APPLICATIONS

This nonprovisional application claims the benefit, under 35 USC §119(e) of U.S. Provisional Application No 61/452,232 filed on Mar. 14, 2011 and under 35 USC §119(a) to European Patent Application No. 11258149.2 filed in the European Patent Office, on Mar. 14, 2011, all of which are hereby expressly incorporated by reference into the present application.

AREA OF THE INVENTION

Hearing aids with behind the ear components are often supplied with switch knobs or the like for users to operate in order to change the signal processing of the electronics inside the casing element behind the ear.

BACKGROUND OF THE INVENTION

For some users, such as small children, these switches are of no use and a disabling of the switch is performed in the software of the hearing aid, prior to the administering to the child of the hearing aid. The knob will however still be sitting on the shell and some children may, by the use of their teeth or some other tool pry the knob off of the shell which leaves a hole in the apparatus with access to the electronics, and also leaves the small part of the knob in the hand of a child, who may swallow it.

SUMMARY OF THE INVENTION

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

In order to solve the above mentioned problems a hearing aid is provided having a behind the ear component comprising a casing adapted to cover, accommodate or protect electronics components of the hearing aid. Further the hearing aid has at least one through going opening in the casing element and electronic switching elements placed at the through going opening. According to the invention a plate element is provided, which is mountable in the through going opening and adapted to form, when mounted herein, a surface flush with the casing. This plate element which covers the switches is used when the switches has been disabled such as is often the case with hearing aids for small children. The flush surface ensures that the child cannot remove the plate like element from the through going hole in the casing, and a more child proof hearing aid is provided. The knob element which necessarily must replace the plate element to work the switches may at a later time be installed if this is desired.

In an embodiment the through going opening in the casing has an elongate shape with parallel sides and rounded end-parts where a bridge element is provided between the two sides, and where the plate element has supports for abutting the bridge part and protrusions at each rounded end adapted for placement below the shell part. This ensures a very safe and secure placement of the plate element. The bridge part, which is shaped integrally with the shell element or provided as a steel pin inserted therein, will ensure that the plate element is not pressed into the hearing aid, and the protruding extensions under the casing material at each end will ensure that the plate cannot be tilted to touch the electronics which are placed inside the hearing aid.

The plate element may comprise recessed surface parts at an underside thereof adapted to accommodate the electronic switch elements. This is advantageous as the switch elements may protrude up-wards in the direction out of the opening in the casing element.

The protrusions at the ends of the plate element may extend into the hearing aid. In this way the plate element is prevented from moving away from the hearing aid at both ends thereof. When the plate element is installed from above, it is bent slightly by pressing the two ends thereof towards each other, whereby the protrusions at the two ends may be placed correctly underneath the casing material while the middle part of the plate element will be seated onto the bridge element.

An upper side recess may be provided at least at one end of the plate element adapted for insertion of a tool part in the intersection between the plate element and the casing part. Such a recess will make it easier, with the aid of a pointed tool to remove the plate element from the casing, such as whenever the user needs to install a usual switch element.

A switch knob may be provided which is adapted to be mounted in the through going opening and releasably fastened to the casing, and adapted to transfer user induced pressure from the outside onto the electronic switching elements for operation thereof. This switch knob will necessarily be shaped to fill out the through going opening and is inserted as replacement for the plate element when the user needs to make use of the switches. This will also require re-programming of the software embedded in the hearing aid in order for the switches to become active again.

BRIEF DESCRIPTION OF THE DRAWINGS

Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF A PREFERRED EMBODIMENT

Figure 1:
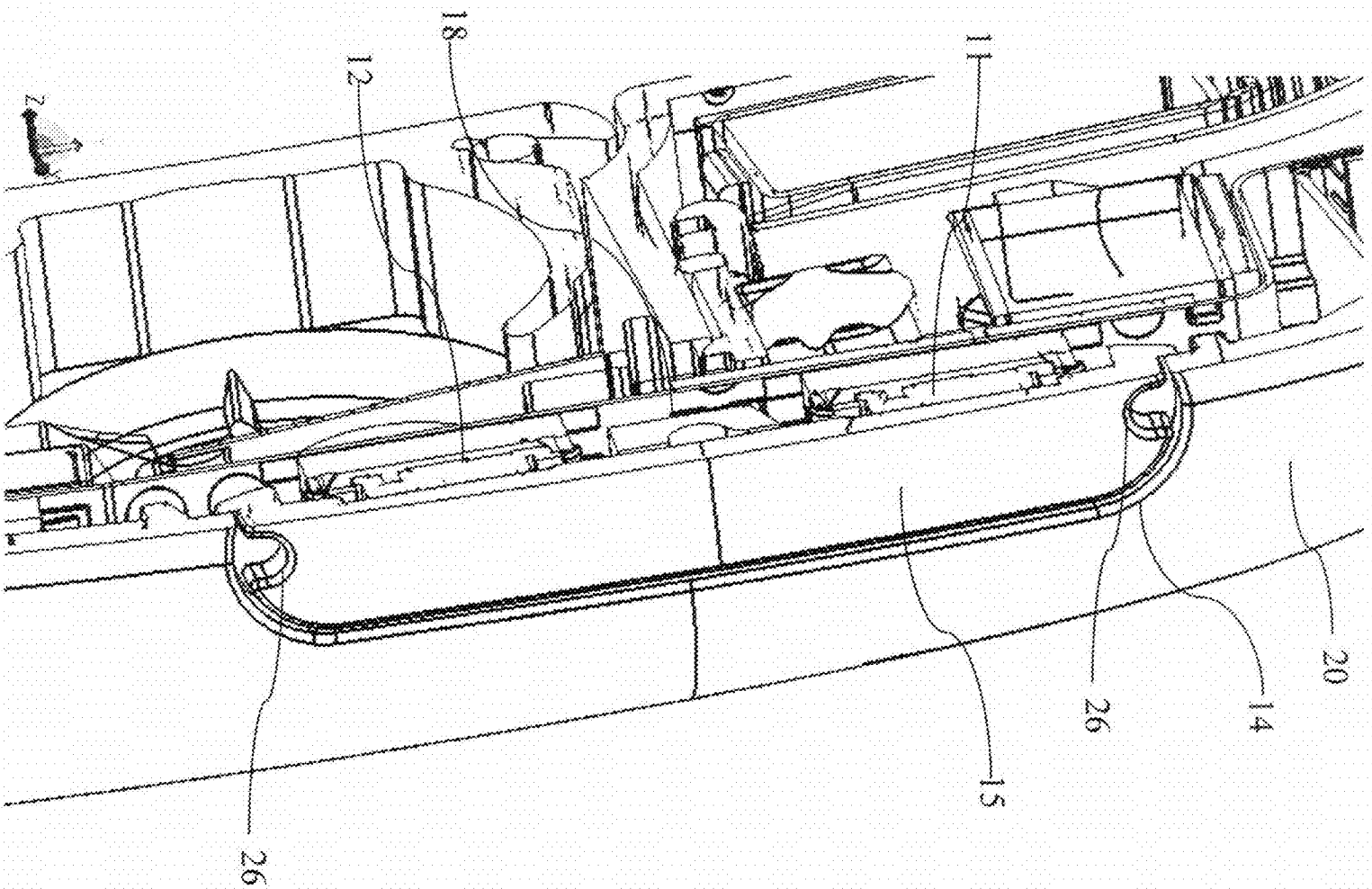
FIGS. 1 and 1*a* shows a sectional view in 3*d* of a hearing aid 1 with the plate like element 15 mounted in the through going opening 14.
Figure 1A:
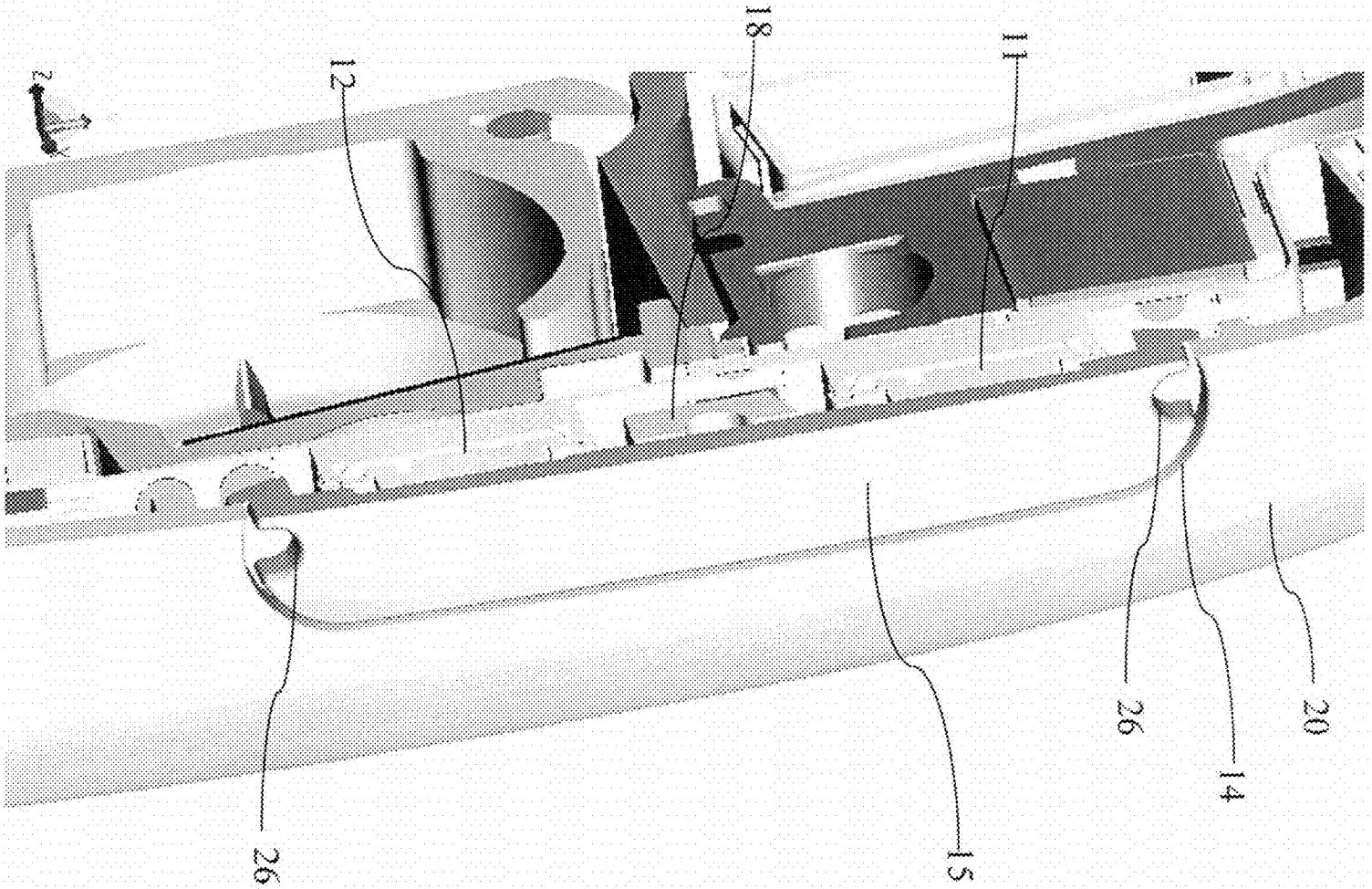
Figure 2:
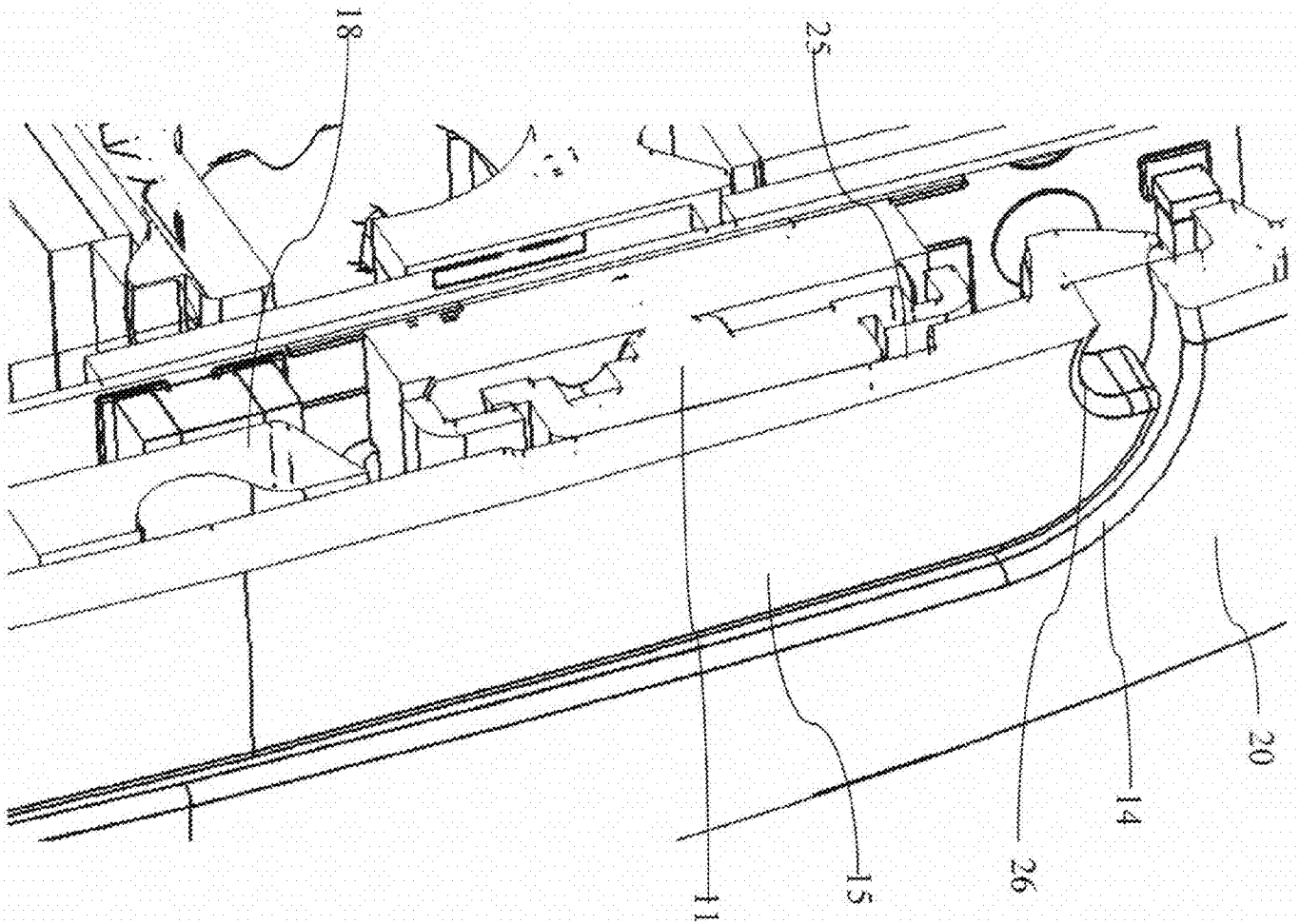
FIGS. 2 and 2*a* depicts a detail from FIG. 1, but in a slightly different 3*d* view.
Figure 2A:
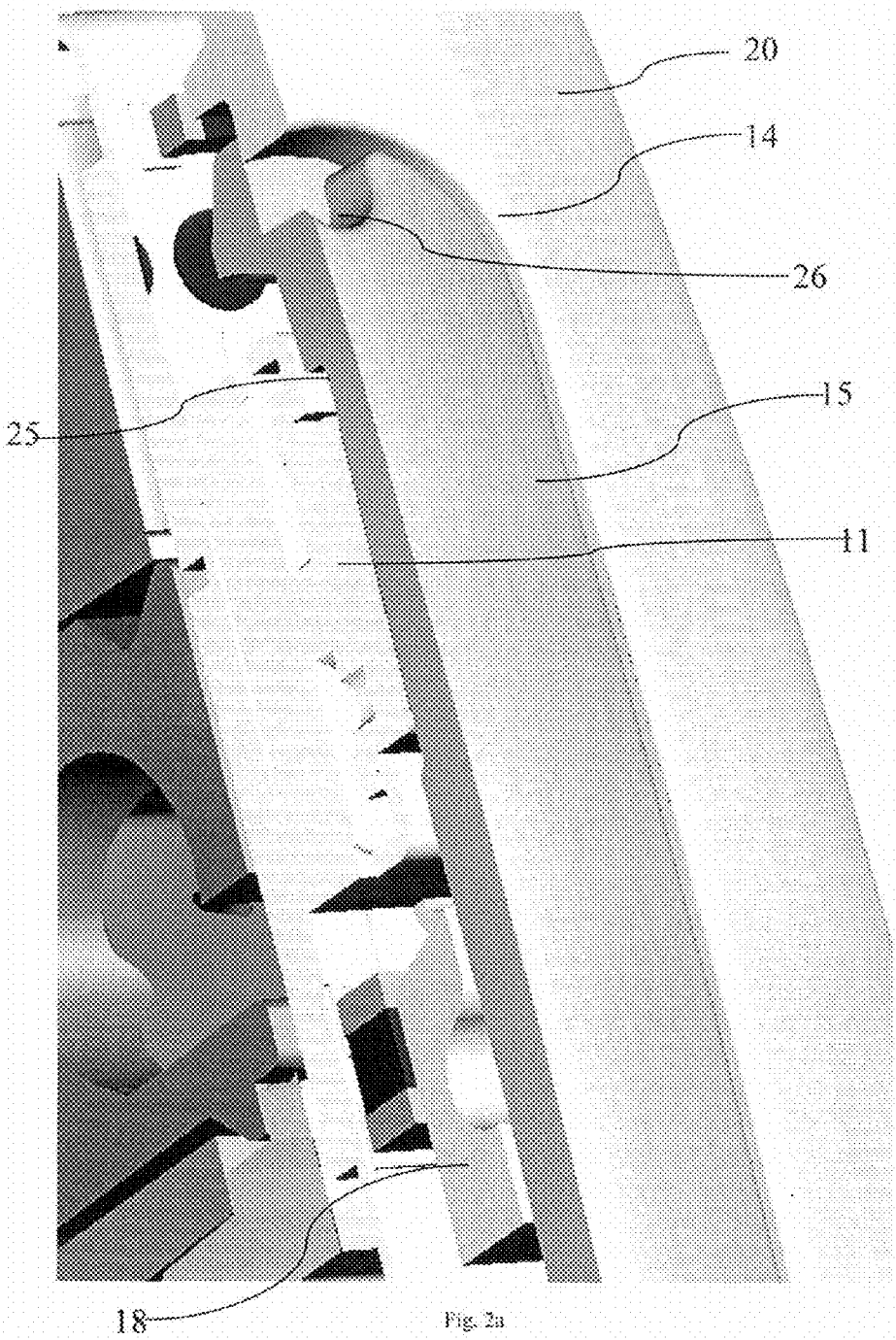
Figure 3:
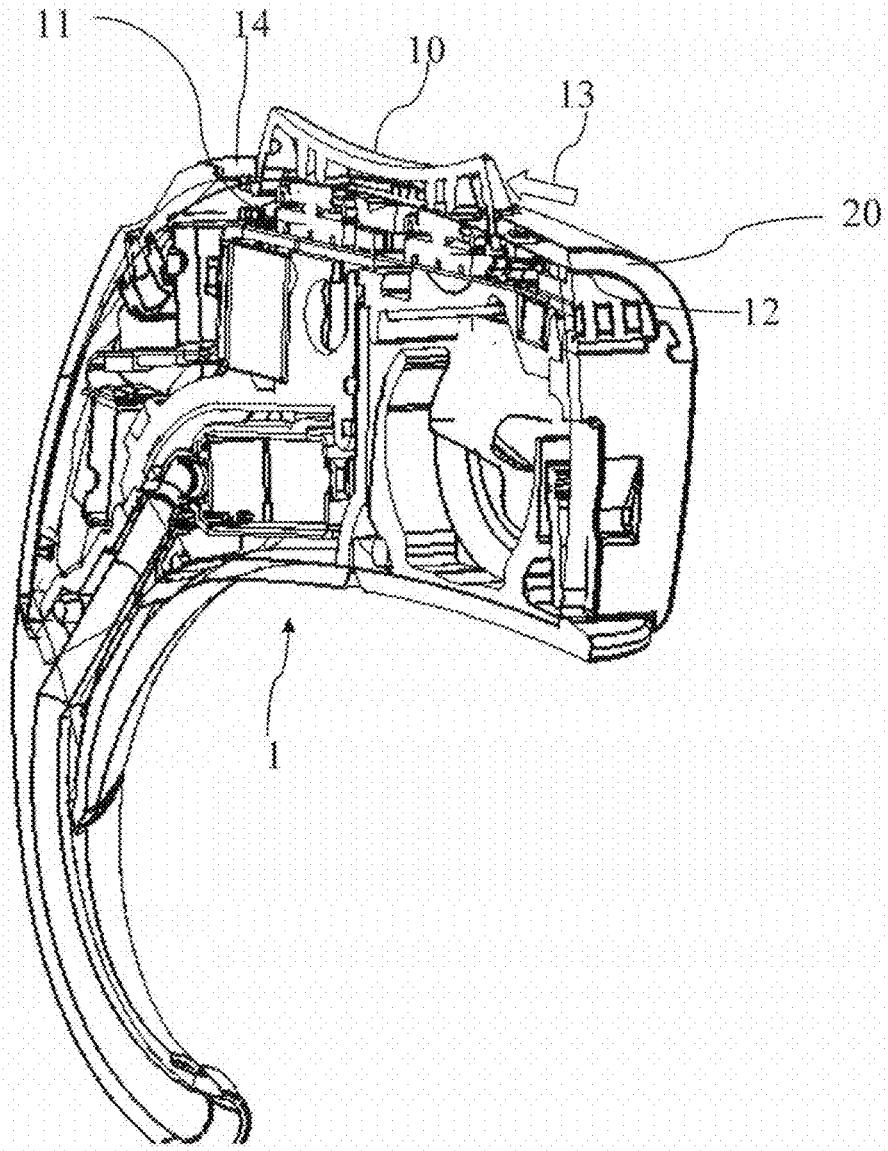
FIGS. 3 and 3*a* shows a hearing aid with a switch knob 4 mounted in the through going opening 3.
Figure 3A:
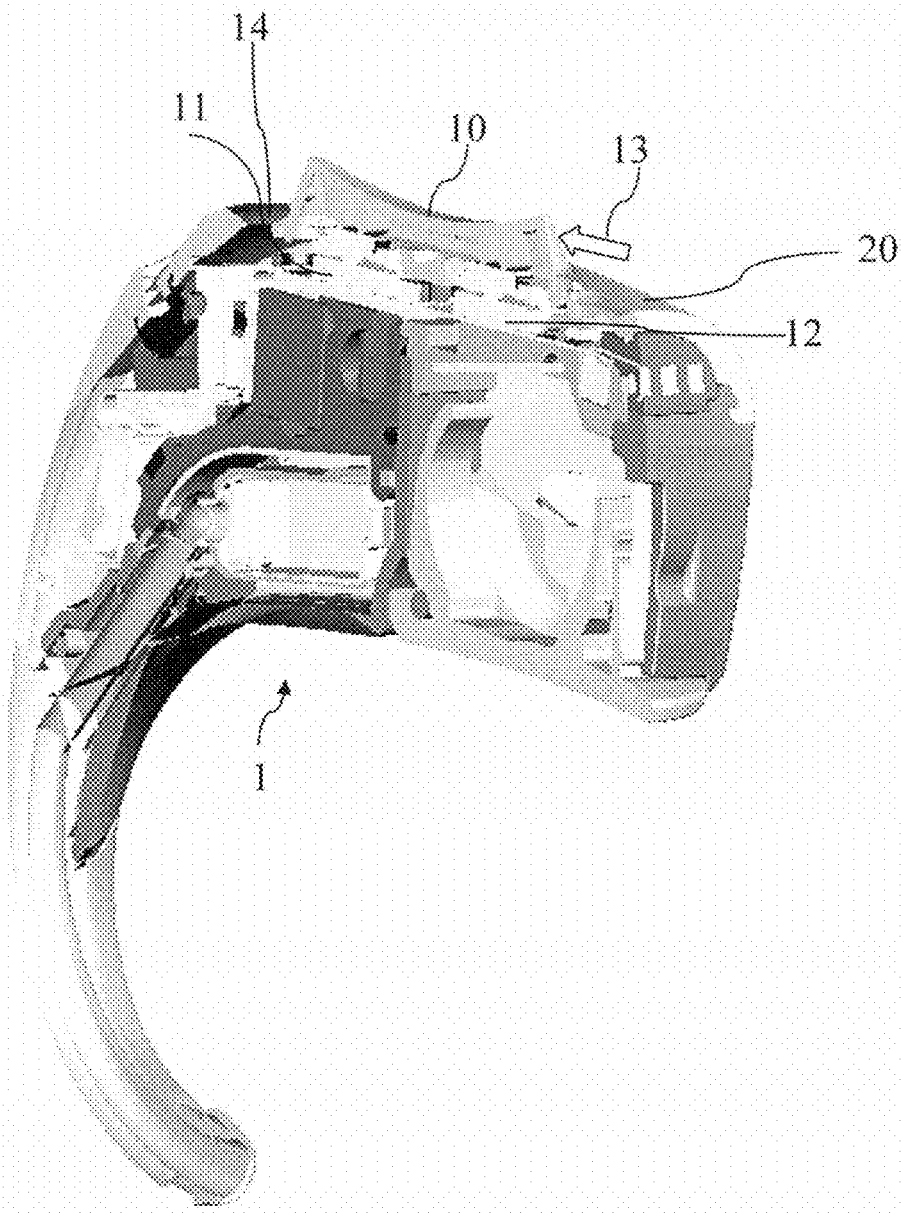

FIGS. 3 and 3*a* shows a prior art hearing aid 1 in sectional view and displayed in 3d projections. A switch knob 10 is installed in the through going opening 14 in the top shell part of the casing, such that the user may operate the switch knob 10 by depressing either one of the two ends thereof in a downward direction. Below the switch knob 10 first and second electromechanical switching devices 11, 12 are placed, such that when the knob 10 is pressed at one end, it may tilt or rotate and cause activation of the one or the other of the electromechanical switches 11,12 depending on which end of the switch knob 10 is depressed. The switches may regulate the function of an amplifier and processing unit provided in the usual manner inside the hearing aid. The processing unit may be embedded in one or more IC devices. Connections between the electromechanical switches and the amplifier is provided in the usual manner by way of a PCB or similar electrical routing device.

The knob 10 is made from elastic material and by applying force to an end part thereof such as in the direction of arrow 13 it may flex and snap out of engagement with the hearing aid 1. In this way the knob may be changed to a colour and shape preferred by the end user.

When this kind of hearing aid device is used by very young children the switches 11, 12 are usually disabled by way of software embedded in the IC device, as such children would not understand and be able to manoeuvre the switch knob 10. Children may expose hearing aid devices to un-desirable treatment such as biting, whereby the switch knob may inadvertently come off.

To avoid this it is suggested to inset a plate element 15 in the through going opening 14, and this is shown in FIGS. 1, 1*a*, 2 and 2*a*. As seen here the plate element 15 is flush with the exterior panel of the casing 20 in which the through going opening 14 is provided. When such a plate element 15 is provided, it will not be possible for the user to remove the plate element from the casing 20 even with the use of teeth or some other tool.

Figure 4:
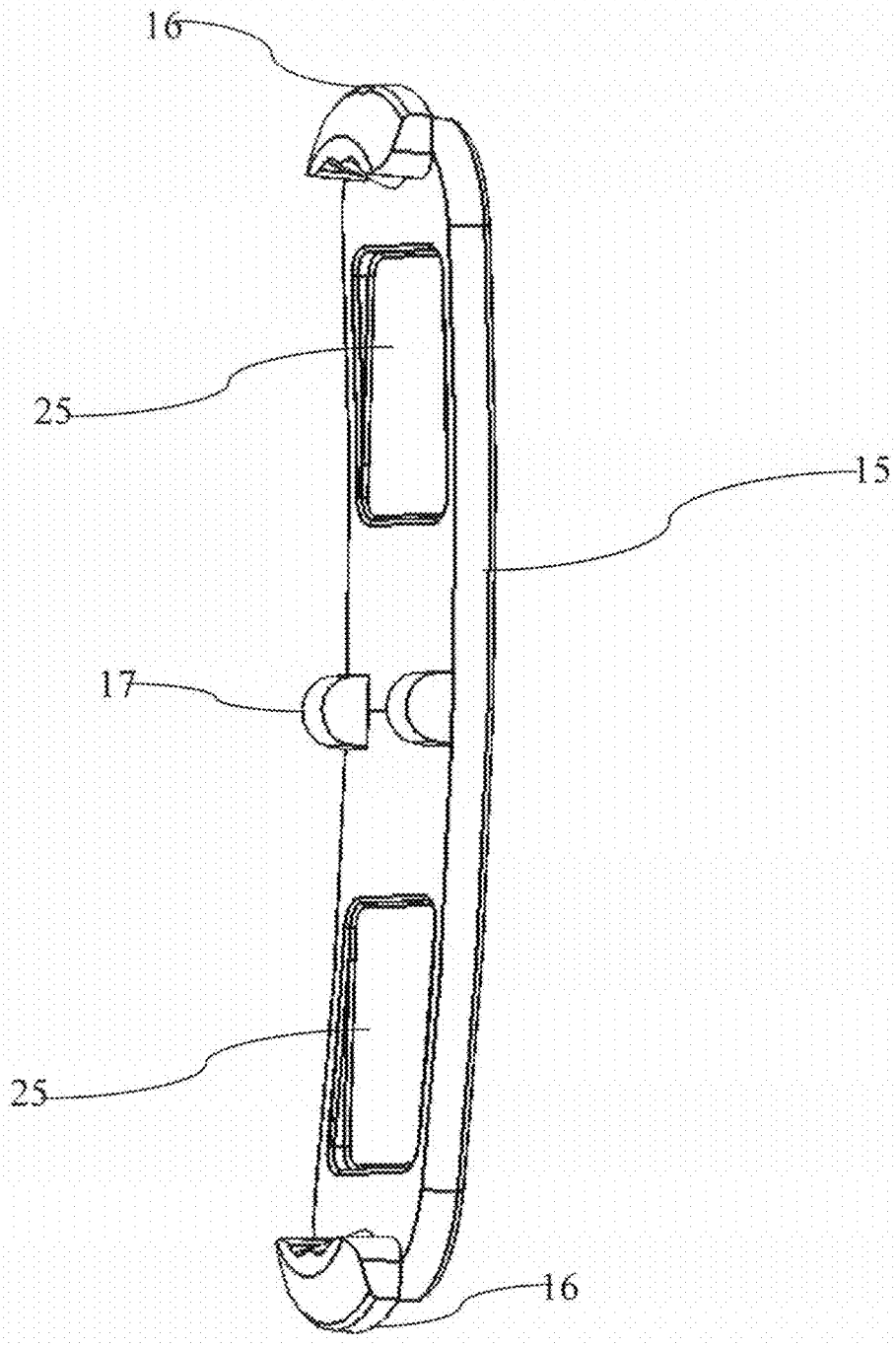
FIG. 4 shows the plate element 15 in 3*d* projection seen from below.

As seen in FIG. 4 the plate element is elongate in order to follow the shape of the opening 14. However the plate may have any shape or form, as long as it is insertable in a casing part to substitute a switch knob. The plate element has rounded end parts, and at each end part a protrusion 16 is provided protruding from an underside thereof. These protrusions 16 are provided to extend underneath the casing part 20 and will ensure that the plate 15 is not removed. To further stabilize the plate 15, supports 17 are provided midways between the two protrusions 16. The supports 17 are to abut a bridge portion 18 of the casing 20 provided midways between the two switching elements 11, 12. The bridge element 18 is moulded integrally with the casing 20, and also serves as abutment and pivot point for the knob 10 when inserted in the opening 14. With the protrusions 16 in place under the casing surface 20 and the supports 17 abutting the bridge 18 the plate 15 will be safely attached to the casing, and cannot in-advertently be removed.

The plate element 15 has recesses 25 at the underside thereof to accommodate the electromechanical switching elements 11, 12, such that the switching elements are not depressed when the plate 5 is mounted in the opening.

On the upper side, the plate element 15 has recesses 26 at both ends thereof abutting the edge, such that a pointed tool may be inserted in one of the recesses 26 in order that the plate element 15 may be lifted out of engagement with the casing. This is performed whenever it is desired to return to the use of a switch knob, which may be when a user such as a child has become old enough to understand and manoeuvre a push button.

The invention claimed is:

1. A hearing aid, comprising:

a behind the ear component including a casing adapted to cover, accommodate or protect electronics components of the hearing aid;

at least one through going opening in the casing;

electronic switching elements placed at the through going opening;

a switch knob configured to be mounted in the through going opening and releasably fastened to the casing, the switch knob further configured to transfer user induced pressure from outside of the casing onto the electronic switching elements; and a plate element which is mountable in the through going opening when the switch knob is released from the through going opening, the plate element forming a surface flush with the casing when mounted in the through going opening, wherein the plate element includes supports protruding from a first face of the plate element, and protrusions extending from the first face, each protrusion having a position at a lateral end of the plate element, the through going opening includes a bridge part between two sides of the through going opening, the bridge part having a recess shaped to receive said supports of the plate element, the supports of the plate element are inserted into the recess of the bridge part and the protrusions of the plate element extend below the casing and anchor the plate element to the casing when the plate element is pressed into the through going opening.

2. Hearing aid as claimed in claim 1, wherein the through going opening in the casing has an elongate shape with parallel sides and rounded endparts.

3. Hearing aid as claimed in claim 1, wherein the plate element comprises recessed surface parts at an underside thereof adapted to accommodate the electronic switch elements.

4. Hearing aid as claimed in claim 1, wherein the protrusions at each lateral end of the plate element extend into the hearing aid.

5. Hearing aid as claimed in claim 1, wherein the plate element further includes:

a recess formed at least at one lateral end, the recess having a shape to enable insertion of a tool part in an intersection between the plate element and the casing.

* * * * *